US010226745B2

(12) United States Patent
Tang

(10) Patent No.: US 10,226,745 B2
(45) Date of Patent: Mar. 12, 2019

(54) EMULSION MATRIX GROUND STATION WITH INTRINSIC SAFETY

(71) Applicant: SHIJIAZHUANG SUCCESS MACHINERY ELECTRICAL CO., LTD., Shijiazhuang, Hebei (CN)

(72) Inventor: Qiuming Tang, Shijiazhuang (CN)

(73) Assignee: SHIJIAZHUANG SUCCESS MACHINERY ELECTRICAL CO., LTD., Hebei (CN)

( * ) Notice: Subject to any disclaimer, the term of this patent is extended or adjusted under 35 U.S.C. 154(b) by 143 days.

(21) Appl. No.: 15/519,618

(22) PCT Filed: Oct. 16, 2014

(86) PCT No.: PCT/CN2014/088730

§ 371 (c)(1),
(2) Date: May 23, 2017

(87) PCT Pub. No.: WO2016/058157

PCT Pub. Date: Apr. 21, 2016

(65) Prior Publication Data

US 2017/0246598 A1 Aug. 31, 2017

(51) Int. Cl.

| | |
|---|---|
| ***B01F 5/00*** | (2006.01) |
| ***B01F 5/06*** | (2006.01) |
| ***C06B 21/00*** | (2006.01) |
| ***B01F 3/08*** | (2006.01) |
| ***B01F 13/00*** | (2006.01) |
| ***B01F 15/00*** | (2006.01) |

(Continued)

(52) U.S. Cl.
CPC ..... *B01F 5/0688* (2013.01); *B01F 3/0807* (2013.01); *B01F 3/0861* (2013.01);
(Continued)

(58) Field of Classification Search
CPC .... B01F 5/0688; B01F 3/0807; B01F 3/0861; B01F 13/0018; B01F 15/00149; B01F 15/00974; B01F 15/0243; B01F 15/06; B01F 2003/0842; B01F 2015/062; B01F 2215/0057; C06B 21/00; C06B 21/0008
See application file for complete search history.

(56) References Cited

U.S. PATENT DOCUMENTS 4,511,414 A * 4/1985 Matsui ..... B01F 3/0807 149/109.6
5,067,508 A * 11/1991 Lee ..... F17D 1/17 137/13

FOREIGN PATENT DOCUMENTS

CN 2585686 Y 11/2003
CN 102718611 A 10/2012
(Continued)

OTHER PUBLICATIONS

Jun. 15, 2015 International Search Report issued in International Patent Application No. PCT/CN2014/088730.
(Continued)

*Primary Examiner* — Anshu Bhatia
(74) *Attorney, Agent, or Firm* — Oliff PLC

(57) ABSTRACT

Provided is an emulsion matrix ground station with intrinsic safety, which relates to the technical field of emulsion matrix preparation process and apparatus of mobile ground auxiliary equipment in civil explosive industry. The emulsion matrix ground station may include a water phase tank, an oil phase tank, a water phase pump, an oil phase pump and a static emulsification device. The water phase pump may have an inlet connected to an outlet of the water phase tank by a pipeline, and an outlet connected to a water phase inlet of the static emulsification device by a pipeline. The oil phase pump may have an inlet connected to an outlet of the oil phase tank by a pipeline, and an outlet connected to an oil phase inlet of the static emulsification device by a pipeline.

4 Claims, 2 Drawing Sheets

(51) Int. Cl.
*B01F 15/02* (2006.01)
*B01F 15/06* (2006.01)

(52) U.S. Cl.
CPC .... *B01F 13/0018* (2013.01); *B01F 15/00149* (2013.01); *B01F 15/00974* (2013.01); *B01F 15/0243* (2013.01); *B01F 15/06* (2013.01); *C06B 21/00* (2013.01); *C06B 21/0008* (2013.01); *B01F 2003/0842* (2013.01); *B01F 2015/062* (2013.01); *B01F 2215/0057* (2013.01)

(56) References Cited

FOREIGN PATENT DOCUMENTS

| | | | |
|---|---|---|---|
| CN | 102850149 | A | 1/2013 |
| CN | 203095905 | U | 7/2013 |
| CN | 203598760 | U | 5/2014 |
| CN | 104109057 | A | 10/2014 |
| EP | 3162785 | A1 | 5/2017 |
| EP | 3199509 | A1 | 8/2017 |
| GB | 2126910 | A | 4/1984 |

OTHER PUBLICATIONS

Apr. 18, 2017 International Preliminary Report on Patentability issued in International Patent Application No. PCT/CN2014/088730.

Jun. 15, 2015 Written Opinion issued in International Patent Application No. PCT/CN2014/088730.

Jan. 15, 2018 Examination Report in Australian Patent Application No. 2014409009.

May 3, 2018 Extended European Search Report issued in European Patent Application No. 14904021.4.

* cited by examiner

EMULSION MATRIX GROUND STATION WITH INTRINSIC SAFETY

TECHNICAL FIELD

The present invention pertains to the technical field of emulsion matrix preparation process and apparatus of mobile ground auxiliary equipment in civil explosive industry, and relates to an emulsion matrix ground station with intrinsic safety.

BACKGROUND

Currently, the domestic emulsion matrix preparation technology has defects such as out-of-date processing methods, poor safety level, high energy consumption, and uneven efficacy of the product, mainly because of the fact that the existing mobile ground station utilizes high speed shear to produce emulsion matrix, which has great potential risk; with a simple transplanting of ground emulsion matrix production technology, there is high requirements for mobile ground station auxiliary systems; and a screw pump is used for transporting, which not only results in the fact that the safety level is poor, but also the overall energy consumption of the entire matrix production system is usually kept at a relatively high level (higher than 80 kW).

SUMMARY OF THE INVENTION

In order to solve the problem in prior arts, the present invention provides an emulsion matrix ground station with intrinsic safety that uses a static emulsification device to produce emulsion matrix by mixing jetted water phase with oil phase, so that no mechanical stirring or shear is involved in the emulsion matrix production process, and thus the production is more safe; also, the emulsion matrix flowing out from an outlet of the static emulsification device is directly loaded into an in-site loading truck for transportation without needing to be pumped, so that the energy consumption is reduced and the safety level is improved.

The present invention is realized by the following technical scheme:

An emulsion matrix ground station with intrinsic safety, characterized in comprising a water phase tank, an oil phase tank, a water phase pump, an oil phase pump and a static emulsification device, wherein, the water phase pump has an inlet connected to an outlet of the water phase tank by a pipeline, and an outlet connected to a water phase inlet of the static emulsification device by a pipeline; the oil phase pump has an inlet connected to an outlet of the oil phase tank by a pipeline, and an outlet connected to an oil phase inlet of the static emulsification device by a pipeline.

Preferably, the static emulsification device comprises the oil phase inlet, the water phase inlet, a flange sleeve, emulsification inner cores and an emulsification device outlet, wherein, an inner sleeve is provided inside the flange sleeve with a sealed cavity formed between an outer wall of the inner sleeve and an inner wall of the flange sleeve, the water phase inlet is provided on a side wall of the flange sleeve and is communicated with the sealed cavity, at least three stages of emulsification inner cores are mounted inside the inner sleeve along a longitudinal direction thereof, each of the emulsification inner cores comprises an emulsification cylinder and annular end plates fixed on both ends of the emulsification cylinder, with each of the annular end plates having an outer diameter equal to an inner diameter of the inner sleeve and being in contact with the inner sleeve in a sealed manner, an orifice plate is provided on one of the end plates of each emulsification inner core and has an array of through holes provided thereon, the end of each emulsification inner core with the orifice plate provided thereon is set as an outlet end, a chamber is formed by an outer wall of the emulsification cylinder, the end plates on both ends of the emulsification cylinder and an inner wall of the inner sleeve, water phase diffluence holes are provided on a side wall of the inner sleeve and have a total number equal to that of the emulsification inner cores, the water phase diffluence holes are communicated with the chamber outside the emulsification cylinder, at least two rows of jet holes are evenly distributed on the outer wall of the emulsification cylinder around an axis thereof, one end of the flange sleeve is set as the oil phase inlet.

Preferably, a water phase filter is provided at an inlet side of the water phase pump and is communicated with a preheating water box that is communicated with the water phase tank; an oil phase filter is provided at an inlet side of the oil phase pump and is communicated with the oil phase tank.

Preferably, the water phase tank is equipped with a feeding screw for adding ammonium nitrate into the water phase tank.

Preferably, a water phase flow meter is mounted at the water phase inlet of the static emulsification device, and an oil phase flow meter is mounted at the oil phase inlet of the static emulsification device.

The present invention has the following notable advantages as compared to prior art: It uses a fully static emulsification device as the emulsification apparatus, and is an emulsion matrix preparation and transportation apparatus with no stirring, no mechanical shear, no emulsion delivering matrix pump in the preparation process of emulsion matrix. The static emulsification device is designed by utilizing a principle of jetting vortex flow emulsification, and the prepared emulsion matrix is directly loaded by means of a hose from the outlet of the static emulsification device into an emulsion tank of an emulsion loading truck, after that the emulsion matrix is directly transported by the loading truck to the field for use, so that the production processing equipment is simplified, the heat explosion possibility due to mechanical friction is eliminated, and the overall energy consumption of the entire production line is reduced. As compared to that of prior art equipment, its operation energy consumption is saved by about 50%.

Figure 1:
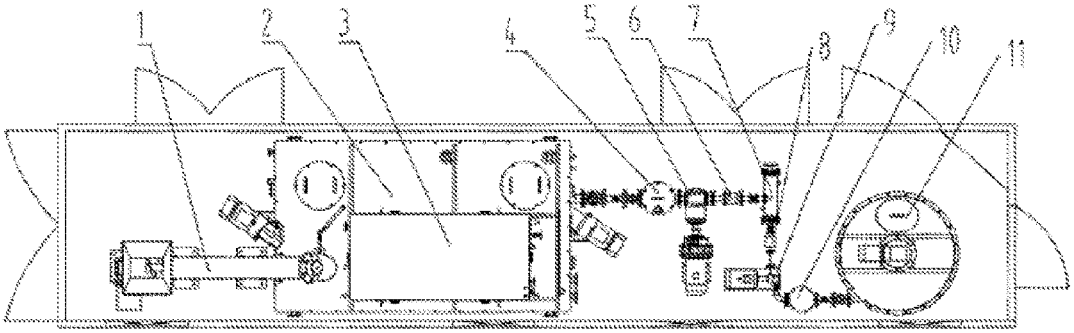
FIG. 1 is a structural schematic diagram of the present invention.

The components shown in the figures are introduced as follows:

1 feeding screw
2 water phase tank
3 preheating water box
4 water phase filter
5 water phase pump
6 water phase flow meter
7 static emulsification device
8 oil phase flow meter
9 oil phase pump
10 oil phase filter
11 oil phase tank

12 oil phase inlet
13 water phase inlet
14 flange sleeve
15 emulsification inner core
16 emulsification device outlet
17 water phase diffluence hole
18 jet hole
19 orifice plate

DETAILED DESCRIPTION OF EMBODIMENTS

The present invention is further described in detail in conjunction with the appended drawings.

Figure 2:
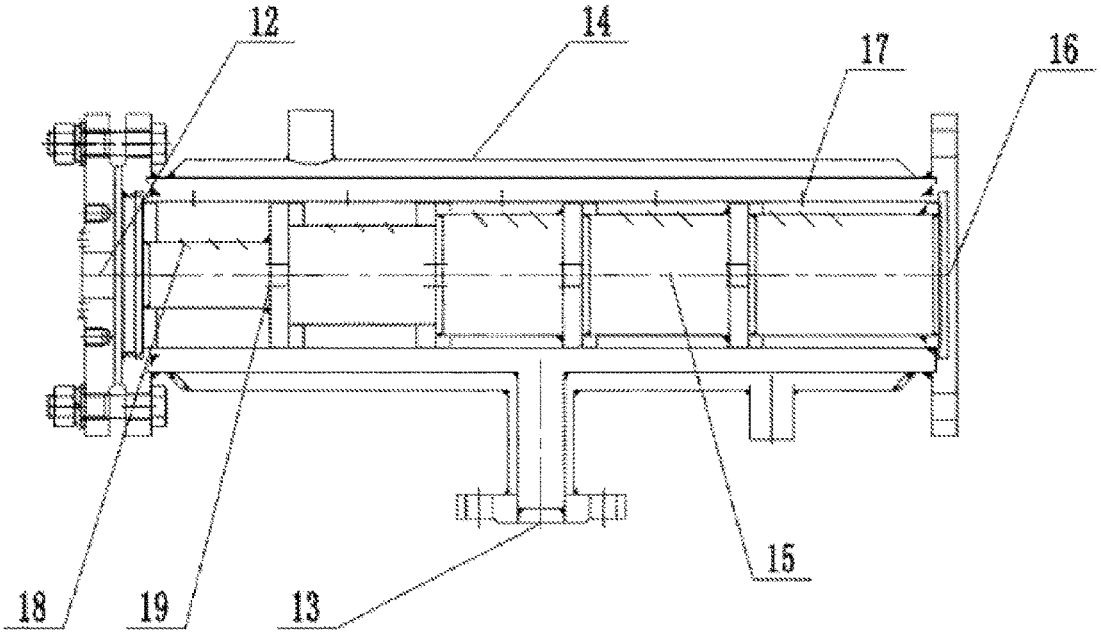
FIG. 2 is a structural schematic diagram of a static emulsification device.
Figure 3:
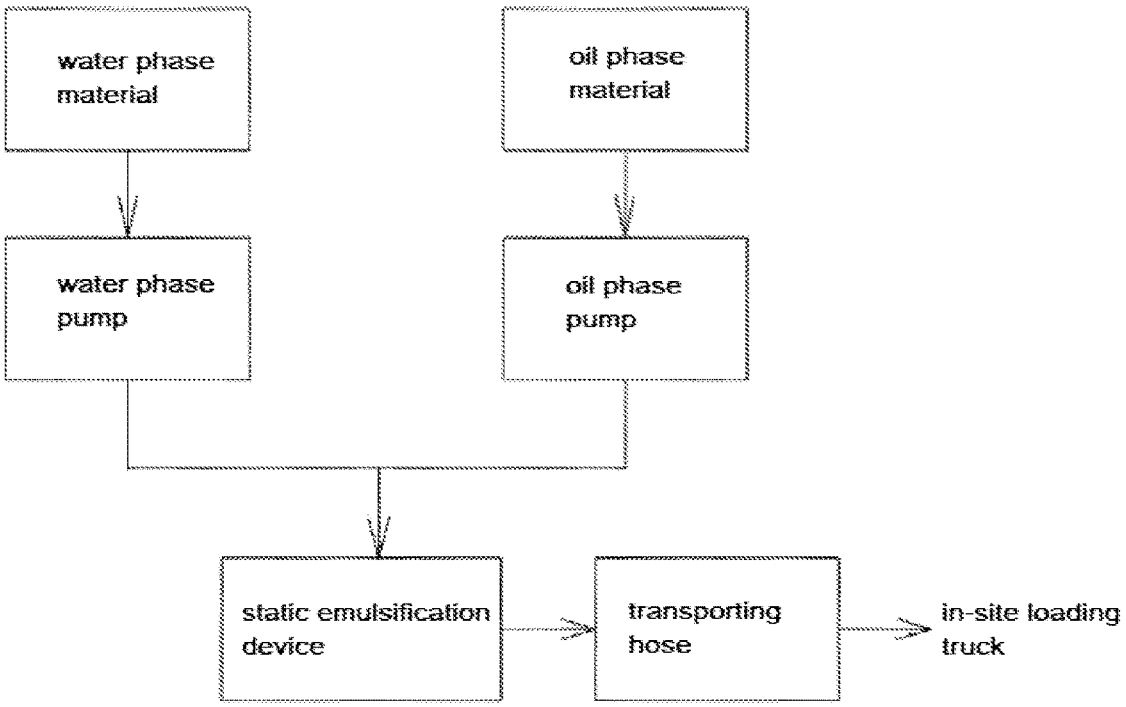
FIG. 3 is a work flow chart of the present invention.

Referring to FIG. 1 to FIG. 3, an emulsion matrix ground station with intrinsic safety comprises a water phase tank 2, an oil phase tank 11, a water phase pump 5, an oil phase pump 9 and a static emulsification device 7, wherein, the water phase pump 5 has an inlet connected to an outlet of the water phase tank 2 by a pipeline, and an outlet connected to a water phase inlet 13 of the static emulsification device 7 by a pipeline; the oil phase pump 9 has an inlet connected to an outlet of the oil phase tank 11 by a pipeline, and an outlet connected to an oil phase inlet 12 of the static emulsification device 7 by a pipeline (as shown in FIG. 1).

The static emulsification device 7 (as shown in FIG. 2) comprises the oil phase inlet 12, the water phase inlet 13, a flange sleeve 14, emulsification inner cores 15 and an emulsification device outlet 16, wherein, an inner sleeve is provided inside the flange sleeve 14 with a sealed cavity formed between an outer wall of the inner sleeve and an inner wall of the flange sleeve 14, the water phase inlet 13 is provided on a side wall of the flange sleeve 14 and is communicated with the sealed cavity, at least three stages of emulsification inner cores 15 are mounted inside the inner sleeve along a longitudinal direction thereof, each of the emulsification inner cores 15 comprises an emulsification cylinder and annular end plates fixed on both ends of the emulsification cylinder, with each of the annular end plates having an outer diameter equal to an inner diameter of the inner sleeve and being in contact with the inner sleeve in a sealed manner, an orifice plate 19 is provided on one of the end plates of each emulsification inner core 15 and has an array of through holes provided thereon, the end of each emulsification inner core 15 with the orifice plate 19 provided thereon is set as an outlet end, a chamber is formed by an outer wall of the emulsification cylinder, the end plates on both ends of the emulsification cylinder and an inner wall of the inner sleeve, water phase diffluence holes 17 are provided on a side wall of the inner sleeve and have a total number equal to that of the emulsification inner cores 15, the water phase diffluence holes 17 are communicated with the chamber outside the emulsification cylinder, at least two rows of jet holes 18 are evenly distributed on the outer wall of the emulsification cylinder around an axis thereof, one end of the flange sleeve 14 is set as the oil phase inlet 12. A water phase filter 4 is provided at an inlet side of the water phase pump 5 and is communicated with a preheating water box 3 that is communicated with the water phase tank 2; an oil phase filter 10 is provided at an inlet side of the oil phase pump 9 and is communicated with the oil phase tank 11. The water phase tank is equipped with a feeding screw 1 for adding ammonium nitrate into the water phase tank. A water phase flow meter 6 is mounted at the water phase inlet 13 of the static emulsification device 7, and an oil phase flow meter 8 is mounted at the oil phase inlet 12 of the static emulsification device 7.

The present invention has the following operation principle and process:

The amounts of water phase and oil phase to be used is calculated according to process formula and production capability, and corresponding amounts of feedstock is added into the water phase tank 2 and the oil phase tank 11 according to process procedures. The feedstock is heated to a certain temperature and kept at that temperature, then the oil phase pump 9 and the water phase pump 5 is actuated to adjust the water-oil ratio to a preset value according to the flow rate of the formula, the emulsion would continuously flow out via a connecting hose from the outlet of the static emulsification device 7, and subsequently, the prepared emulsion can be directly loaded into an emulsion tank of an emulsion explosive in-site loading truck, so as to be transported to the explosion site for use.

The static emulsification device 7 is a key device in the emulsification process, and hereinafter the structure and operation principle of this device is explained for illustrating the emulsification process. As shown in FIG. 2, the static emulsification device 7 comprises an oil phase inlet 12, a water phase inlet 13, a flange sleeve 14, emulsification inner cores 15 and an emulsification device outlet 16, wherein multiple emulsification inner cores 15 are successively mounted in one static emulsification device. Its emulsification process is as follows:

The oil phase is fed into the first emulsification inner core 15 through a starting end of the oil phase inlet 12 of the static emulsification device 7 from the oil phase tank 11 by means of the oil phase pump 9 according to the ratio for explosive; a part of the water phase, which has entered through the lateral water phase inlet 13, jets at a certain flow velocity through the jet holes 18 distributed on the emulsification inner core 15 of the static emulsification device 7 so as to enter the emulsification inner core 15 and be mixed with the oil phase, and then the mixture of the two jets at certain flow velocity through the end-face orifice plate 19 of the emulsification inner core 15 so as to form a first-stage coarse emulsion; the effluent is mixed again in the second emulsification inner core 15 with another part of the water phase material whose flow is divided from the water phase inlet 13, and subsequently jets at certain flow velocity through the end-face orifice plate 19 of the second emulsification inner core 15 so as to form a second-stage emulsion; and so on, by going through multiple stages of repeated mixing and shear action, the emulsified emulsion is finally produced. Such a method for producing emulsion does not involve mechanical stirring or mechanical shear, and thus operates safely.

Consequently, the present invention utilizes a completely static emulsification device as the emulsification apparatus, and is an emulsion matrix preparation and transportation apparatus with no stirring, no mechanical shear, no emulsion delivering matrix pump in the preparation process of emulsion matrix. The static emulsification device is designed by utilizing a principle of jetting vortex flow emulsification, and the prepared emulsion matrix is directly loaded by means of a hose from the outlet of the static emulsification device into an emulsion tank of an emulsion loading truck, after that the emulsion matrix is directly transported by the loading truck to the field for use, so that the production processing equipment is simplified, the heat explosion possibility due to mechanical friction is eliminated, and the overall energy consumption of the entire production line is reduced. As compared to that of prior art equipment, its operation energy consumption is saved by about 50%.

The invention claimed is:

1. An emulsion matrix ground station with intrinsic safety, comprising a water phase tank, an oil phase tank, a water phase pump, an oil phase pump and a static emulsification device, wherein, the water phase pump has an inlet connected to an outlet of the water phase tank by a pipeline, and an outlet connected to a water phase inlet of the static emulsification device by a pipeline;

the oil phase pump has an inlet connected to an outlet of the oil phase tank by a pipeline, and an outlet connected to an oil phase inlet of the static emulsification device by a pipeline wherein the static emulsification device comprises the oil phase inlet, the water phase inlet, a flange sleeve, emulsification inner cores and an emulsification device outlet, wherein, an inner sleeve is provided inside the flange sleeve with a sealed cavity formed between an outer wall of the inner sleeve and an inner wall of the flange sleeve, the water phase inlet is provided on a side wall of the flange sleeve and is communicated with the sealed cavity, at least three stages of emulsification inner cores are mounted inside the inner sleeve along a longitudinal direction thereof, each of the emulsification cores comprises an emulsification cylinder and annular end plates fixed on both ends of the emulsification cylinder, with each of the annular end plates having an outer diameter equal to an inner diameter of the inner sleeve and being in contact with the inner sleeve in a sealed manner, an orifice plate is provided on one of the end plates of each emulsification inner core and has an array of through holes provided thereon, the end of each emulsification inner core with the orifice plate provided thereon is set as an outlet end, a chamber is formed by an outer wall of the emulsification cylinder, the end plates on both ends of the emulsification cylinder and an inner wall of the inner sleeve, water phase diffluence holes are provided on a side wall of the inner sleeve and have a total number equal to that of the emulsification inner cores, the water phase diffluence holes are communicated with the chamber outside the emulsification cylinder at least two row of jet holes are evenly distributed on the outer wall of the emulsification cylinder around an axis thereof, one end of the flange sleeve is set as the oil phase inlet.

2. The emulsion matrix ground station with intrinsic safety of claim 1, wherein, a water phase filter is provided at an inlet side of the water phase pump and is communicated with a preheating water box that is communicated with the water phase tank; an oil phase filter is provided at an inlet side of the oil phase pump and is communicated with the oil phase tank.

3. The emulsion matrix ground station with intrinsic safety of claim 2, wherein, the water phase tank is equipped with a feeding screw for adding ammonium nitrate into the water phase tank.

4. The emulsion matrix ground station with intrinsic safety of claim 3, wherein, a water phase flow meter is mounted at the water phase inlet of the static emulsification device, and an oil phase flow meter is mounted at the oil phase inlet of the static emulsification device.

* * * * *